United States Patent [19]

Klumparendt

[11] Patent Number: 4,765,484

[45] Date of Patent: Aug. 23, 1988

[54] GLASS SORTING APPARATUS

[75] Inventor: Wolfgang Klumparendt, Dettenheim-Lie, Fed. Rep. of Germany

[73] Assignee: MAB Marlies Kellermann, Dettenheim-Lie, Fed. Rep. of Germany

[21] Appl. No.: 50,863

[22] Filed: May 18, 1987

[30] Foreign Application Priority Data

May 30, 1986 [DE] Fed. Rep. of Germany ..... 3618173

[51] Int. Cl.[4] ..... B07C 5/342

[52] U.S. Cl. ..... 209/577; 209/576

[58] Field of Search ..... 209/576, 577, 578, 579

[56] References Cited

U.S. PATENT DOCUMENTS 3,628,657 12/1971 Billett ..... 209/579

3,890,221 6/1975 Muehlethaler ..... 209/577

FOREIGN PATENT DOCUMENTS 2230724 2/1972 Fed. Rep. of Germany ..... 209/577

2576008 7/1986 France ..... 209/577

*Primary Examiner*—A. Michael Chambers

*Assistant Examiner*—John C. Fox

[57] ABSTRACT

A glass sorting apparatus for the removal of non-glass components from a mixture includes a slide on which the parts are moved in a discrete fashion such that they can be individually identified when moving over a slide window through which light is passed and the slide has a gate arranged downstream of the window which gate is momentarily opened when a non-glass part is identified by the light such that the non-glass part is discharged through the gate so as to be separated from the mixture.

6 Claims, 1 Drawing Sheet

GLASS SORTING APPARATUS

BACKGROUND OF THE INVENTION

The invention relates to a glass sorting apparatus, that is, to the separating arrangement of a glass sorting apparatus for sorting out of a glass mixture parts which do not consist of glass or glass to which non-glass parts are adhering.

With the growing environmental conscientiousness and the growing desire to save energy, it is increasingly considered desirable to recycle used materials. This is also true for glass which is actually a valuable waste material and which is manufactured with the consumption of a relatively large amount of energy. Waste and scrap glass are already being collected for recycling procedures. However, glass is generally received by the recycler in the form of fragments or as bottles which are heavily soiled and, in any case, mixed with other undesirable materials which need to be removed before remelting. Generally, the glass also must be sorted on the basis of its color. The invention relates to such a sorting process in which undesirable parts or fragments are removed from the glass mixture before recycling.

Especially objectionable in the glass mixture are ceramics or stoneware but those materials are present to a large measure since the consumer providing the glass scrap and the glass scrap collectors erroneously consider glass, ceramics and stoneware to be the same in principle. Also, metal parts are impurities which are frequently present in the form of cemented metal foils or screw caps or other closure devices. Paper labels on the other hand are not particularly objectionable since they, as well as some organic material components, are easily combustible.

In order to remove the objectionable materials from the glass mixture, the glass mixture is generally spread onto a conveyor belt and parts having such objectionable materials associated therewith are normally removed from the conveyor belt. Although machine glass sorting processes have been tried and tested, the tests did not lead to success. The reasons for the failures are that on one hand the objectionable parts could not be properly recognized and distinguished by the sensing equipment utilized and in addition they could not be adequately separated and removed from the mixture.

As a recognition procedure, transillumination by exposure to light may readily be taken into consideration since all the objectionable materials are opaque. It is pointed out however that also paper and accordingly glass with paper cemented thereon is opaque and such glass would therefore be discarded although it could be utilized as pointed out above. Considering that a large part of the glass parts is provided with labels, a large amount of glass would be unnecessarily discarded.

It is therefore the object of the present invention to provide a glass separating apparatus capable of removing from the recycle glass mixtures the undesirable parts but not the glass parts provided with paper labels which are usable for recycling.

SUMMARY OF THE INVENTION

In a glass sorting apparatus for the removal of non-glass parts or glass parts with non-glass components attached thereto from a glass mixture the parts are moved over a slide in a discrete fashion. The slide includes a window with light sending and receiving units arranged at opposite sides thereof so that the parts are passing through the light directed from the sending to the receiving unit for individual identification of the parts. Downstream of the window the slide has a drop gate adapted to be momentarily opened under the control of the light receiving unit in a somewhat delayed manner such that a part identified as being undesirable is discharged through the gate and only the remaining parts are permitted to continue to the end of the slide.

With the apparatus according to the invention the glass mixtures to be sorted while passing over the slide are separated from one another and disposed essentially in alignment in the travel direction so that they can be individually identified by means of the light sending and receiving equipment, that is, the mixture can be classified by glass and other components. Whenever a non-glass part is identified, the gate is opened under the control of the light sending and receiving equipment such that, depending on the travel speed of the parts on the slide, after the appropriate time the gate is opened such that the identified non-glass part is permitted to pass through the gate for its removal from the mixture. Obviously, also usable glass parts will be removed from the mixture but their relative amount is quite small and actually without importance. If the parts sorted out of the mixture still include appreciable amounts of usable glass, they can easily be subjected to a second classifying procedure.

Identification of non-glass parts by way of the light sending and receiving equipment may be influenced by the selection of the wavelength of the light selected. In accordance with the invention not only light in the visible range is to be utilized in the process but also ultraviolet and infrared light is utilized. Under certain conditions, that is, for the classification of some glasses, it is advisable, for example, to use UV light between 300 nm and 3000 nm, that is, light in the range of UV-A, particularly for the separation of special glasses. However for the usual glass supplied for recycling, light of an infrared wavelength close to visible light is desirable since light of this wavelength passes through paper labels but not through metal parts. As a result the classification apparatus will accept glass parts with paper cemented thereon but will reject glass parts provided with metal foils. Especially good results are obtained by the use of laser light, particularly if the light receiver consists of a plurality of light sensors arranged side-by-side below the slide and the laser light is conducted to locations above the sensors by way of light conducting fibers so as to direct the light to the appropriate sensors. The sensors preferably are photo cells or elements or photo diodes as well as photo resistors selected as suitable depending on the frequency range of the light utilized.

In order to avoid reciprocal interference of the light converters the light converters are preferably arranged at the end of light-shading tubes.

Tests performed with the arrangement according to the invention indicate that it is indeed possible to classify the glass mixture quite accurately so that only a relatively small amount of glass is discarded together with the non-glass parts and the remaining glass is pure glass which can easily be recycled.

SHORT DESCRIPTION OF THE DRAWINGS

FIG. 1 schematically shows the arrangement according to the invention; and

FIG. 2 is a top view of a light sensing arrangement.

DESCRIPTION OF THE PREFERRED EMBODIMENT

Figures 1, 2:
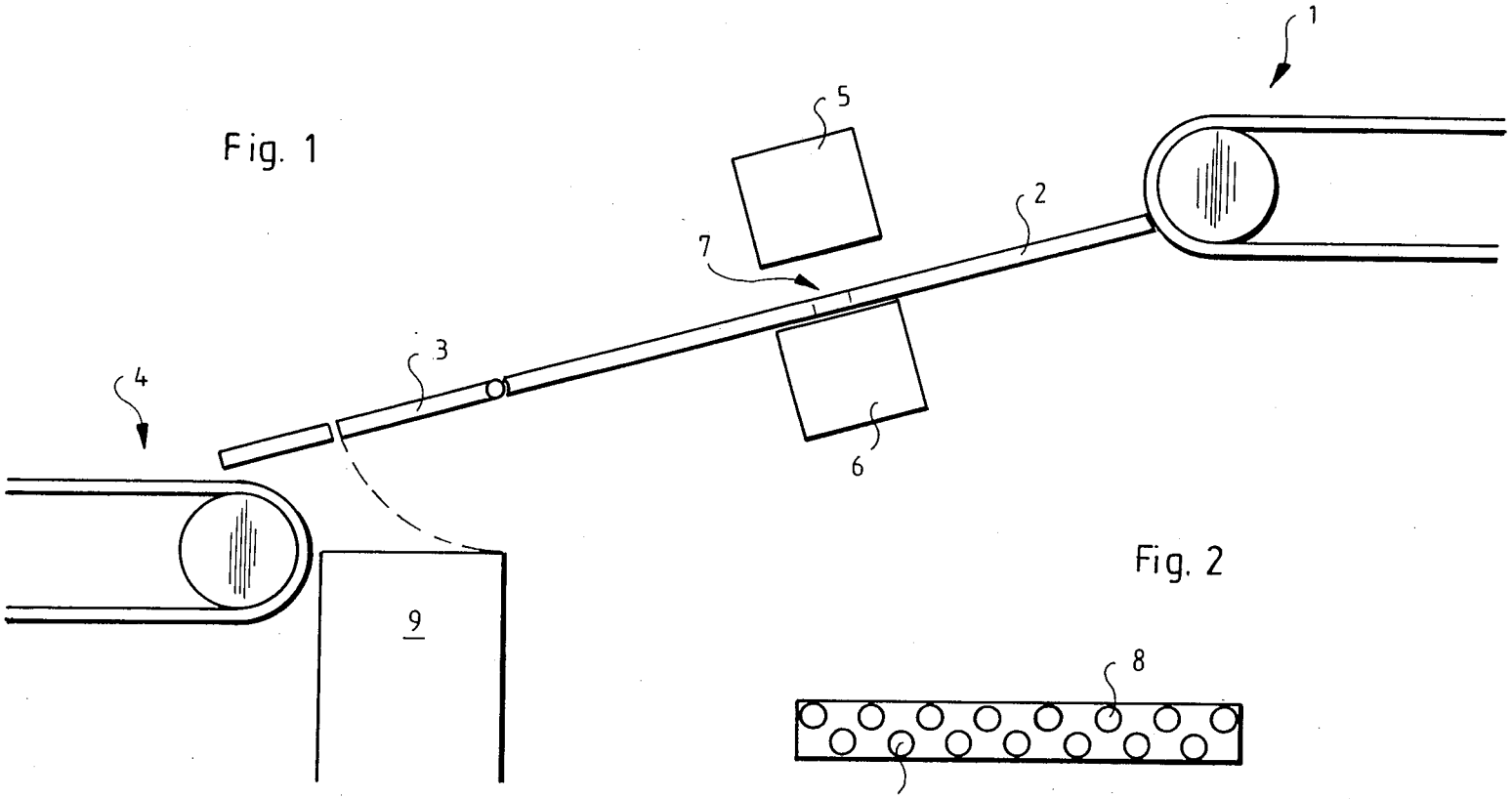

As shown in FIG. 1 a glass mixture is supplied by a conveyor 1 to a slide 2 on which the glass is sliding downwardly and over a drop gate 3 to a conveyor 4 to be carried away. Light sending and receiving units 5, 6 are disposed at opposite sides of the slide 2 so that the parts of the mixture sliding down the slide are passing through a space between the sending and receiving units so as to pass through the light beams from the sending to the receiving units. Preferably the sending unit 6 is arranged below the slide and the receiving unit is arranged above the slide since it has been found that better results are achievable with this arrangement. The slide 2 has a transparent section 7 for passage of the light beams from the light sending unit 6 to the light receiving unit 5. As shown in FIG. 2 the light receiving unit 5 includes a plurality of light converters 8 which are arranged side-by-side in such a manner that any part of the glass mixture passing on the slide through the space between the sending and receiving units is evaluated by at least one of the light converters.

When the glass mixture supplied to the slide 2 by way of the conveyor 1 slides down the slide 2 toward the conveyor 4, the parts making up the mixture are essentially separated when moving past the light sending and receiving units 5, 6. If a non-glass part is detected on the slide 2 among the mixture parts, the drop gate 3 is opened momentarily, for example, by way of an electromagnet, with a delay which depends on the sliding velocity of the parts on the slide 2 such that the non-glass part identified is removed from the slide through the gate and drops into a waste container 9 or is admitted to a second sorting procedure. For glass parts the gate will not be opened so that glass parts slide over and past the gate and are deposited on the conveyor 4 which carries them away for recycling.

Although the slide 2 is shown inclined it preferably has at least one vibrator 10 mounted thereon which insures forward movement of the parts thereon. With an appropriately oriented vibrator the slide does not need to be inclined downwardly in the direction of movement of the parts thereon. In fact more accurately controllable parts movement can be achieved by vibrator-controlled movement of the parts on the slide.

What is claimed is:

1. A glass sorting apparatus for the removal of non-glass parts or glass parts with non-glass components attached thereto from a mixture of glass, paper-labeled glass and non-glass parts, said apparatus comprising first conveyor means for supplying said mixture, second conveyor means for carrying away some of said mixture, said first conveyor means having a discharge end disposed at a first elevation and said second conveyor having a loading end at a lower elevation, a slide extending between the discharge end of said first and the loading end of said second conveyor and being adapted to provide for a predetermined slide speed of the parts deposited thereon, said slide having a transparent section and light sending and receiving units arranged on opposite sides thereof such that any part moving on the slide will pass over said transparent section and past said light sending and receiving units, said light sending unit being adapted to emit an infrared radiation close to visible light and being so arranged as to direct said infrared light toward said receiving unit through said transparent section of said slide and said slide further having a drop gate arranged downstream of said light sending and receiving units and controlled by said light receiving unit so as to be momentarily opened upon sensing of the presence of a non-glass part with a delay depending on the part slide speed such that the non-glass part is discharged through the momentarily opened drop gate.

2. Apparatus according to claim 1, wherein said light sending unit is a laser light source.

3. Apparatus according to claim 1, wherein said light sending unit has glass fiber light conductors associated therewith for guiding light to the location opposite the light receiving unit.

4. Apparatus according to claim 1, wherein said light receiving unit includes a plurality of light converters arranged in a side-by-side relationship.

5. Apparatus according to claim 4, wherein said light converters are disposed at the end of light-shading tubes.

6. Apparatus according to claim 1, wherein said slide is provided with a vibrator for controlled movement of said glass parts on said slide.

* * * * *